United States Patent [19]

Sheffer

[11] Patent Number: 4,664,268

[45] Date of Patent: May 12, 1987

[54] BAR OR BOOKSHELF SUBASSEMBLY CONSTRUCTION

[75] Inventor: Phil B. Sheffer, New Oxford, Pa.

[73] Assignee: Merchandising Innovations, Inc., Hanover, Pa.

[21] Appl. No.: 835,207

[22] Filed: Mar. 3, 1986

[51] Int. Cl.[4] ..... A47F 5/00

[52] U.S. Cl. ..... 211/183; 229/DIG. 1

[58] Field of Search ..... 211/183; 229/DIG. 1; 206/586; 248/174

[56] References Cited

U.S. PATENT DOCUMENTS

| | | | |
|---|---|---|---|
| 2,135,093 | 11/1938 | Abrams | 248/174 |
| 2,967,625 | 1/1961 | Hoogenstyn | 211/183 |
| 3,734,389 | 5/1973 | Brown | 229/DIG. 1 X |
| 3,866,550 | 2/1975 | Gerschwender | 297/440 X |
| 3,900,156 | 8/1975 | Clark, Jr. | 229/DIG. 1 X |
| 3,929,536 | 12/1975 | Maughan | 229/DIG. 1 X |
| 4,192,423 | 3/1980 | Rekow | 229/DIG. 1 X |

*Primary Examiner*—Ramon S. Britts
*Assistant Examiner*—Sarah A. Lechok Eley
*Attorney, Agent, or Firm*—Daniel J. O'Connor

[57] ABSTRACT

A bar or bookshelf subassembly construction which is comprised almost entirely of a light-weight corrugated fiberboard material. The device comprises plural layers of factory formed and glued corrugated fiberboard materials which are arranged such that bar shelving elements may be easily placed therein. A plastic track means (80) is factory glued to the subassembly so that various advertising messages or school logos, for example, may be readily slid into a display area of the bar. An engineered construction is utilized whereby the rough corrugated edges are hidden from view within the bar such that a very attractive bar or bookshelf is produced from light-weight and inexpensive materials.

1 Claim, 5 Drawing Figures

BAR OR BOOKSHELF SUBASSEMBLY CONSTRUCTION

Papers relating to the present invention were previously filed under the Disclosure Document Program of the United States Patent Office.

BACKGROUND AND OBJECTS OF THE INVENTION

This invention relates generally to an apparatus and method of constructing a vertical upright to be used in a bookshelf or bar assembly.

The use of light-weight furniture components which may be shipped in a flat or knockdown position is highly advantageous in achieving a desired reduction of shipping and warehousing costs.

Prior art furniture systems which have used corrugated fiberboard have suffered the drawbacks of being difficult to assemble by the purchaser and of being unstable for their intended uses.

Accordingly, it is an object of the present invention to provide a bar or bookshelf subassembly which is comprised of light-weight corrugated fiber-board materials which may be shipped in a flat or knockdown position to reduce transportation and warehousing costs.

It is a further object to provide a bar or bookshelf subassembly which yields an easy to assemble and durable bar for use by consumers unfamiliar with complex furniture assembly techiques.

It is a still further object to form a bar subassembly having track means added as a part thereof to serve the purpose of allowing multiple display panels to be added to the bar.

It is a further object to provide a bar subassembly of corrugated fiberboard materials which allows the corrugations to be hidden from view upon assembly of the bar to yield a more attractive finished furniture article.

Further objects and advantages of the present invention will become apparent as the following description proceeds, and the features of novelty characterizing the invention will be pointed out with particularity in the claims annexed to and forming a part of this specification.

PRIOR ART PATENTS

The most relevant prior art teachings presently known to the inventor herein are listed as follows: U.S. Pat. No. 3,866,550 issued to Geschwender on Feb. 18, 1975; U.S. Pat. No. 3,307,767 issued to Humphrey et al on Mar. 7, 1967; U.S. Pat. No. 3,987,737 issued to Smith on Oct. 26, 1976.

The U.S. Pat. No. 3,866,550 of Geschwender shows, inter alia, a paperboard bar assembly wherein at least some of the component parts thereof are held in place via cover element 38 and 39.

The U.S. Pat. No. 3,307,767 of Humphrey et al illustrates a bood case design wherein shelving units 46 are secured to side wall panels by means of flaps 58 and 60.

The U.S. Pat. No. 3,987,737 of Smith shows a constructed stand article wherein at least portions of the walls thereof are retained by means of slot elements 10.

As illustrated by the above patents, prior art systems have required relatively complex assembly procedures for furniture articles thus depressing sales and widespread use of such items.

The above prior art patents do illustrate some of the broader aspects of the present invention. However, as will be appreciated in the disclosure herein, the invention design yields an end product which is very easy to assemble and yet durable and attractive in appearance in contrast to systems heretofore known in the art.

BRIEF SUMMARY OF THE INVENTION

The present invention utilizes a layered configuration of corrugated fiberboard materials which are factory pre-glued into a vertical upright assembly which is highly durable in its intended use and which is also very attractive in overall appearance.

The attractive appearance of the unit is achieved via a vinyl coating process applied to portions of the corrugated material which are visiable upon assembly. The vinyl coating process referred to herein is the subject of a separate U.S. patent application.

The attractive appearance of the unit is further achieved by a unique engineering design which covers the fluted end portions of corrugated fiberboard layers which make up the assembly.

A further advantage of the invention design is that the use of screws and fasteners by the purchaser is eliminated. The bar or bookshelf unit can be completely assembled by the user via the simple sliding together of factory preformed component parts.

BRIEF DESCRIPTION OF THE DRAWING FIGURES

DESCRIPTION OF THE PREFERRED EMBODIMENT

Figure 1:
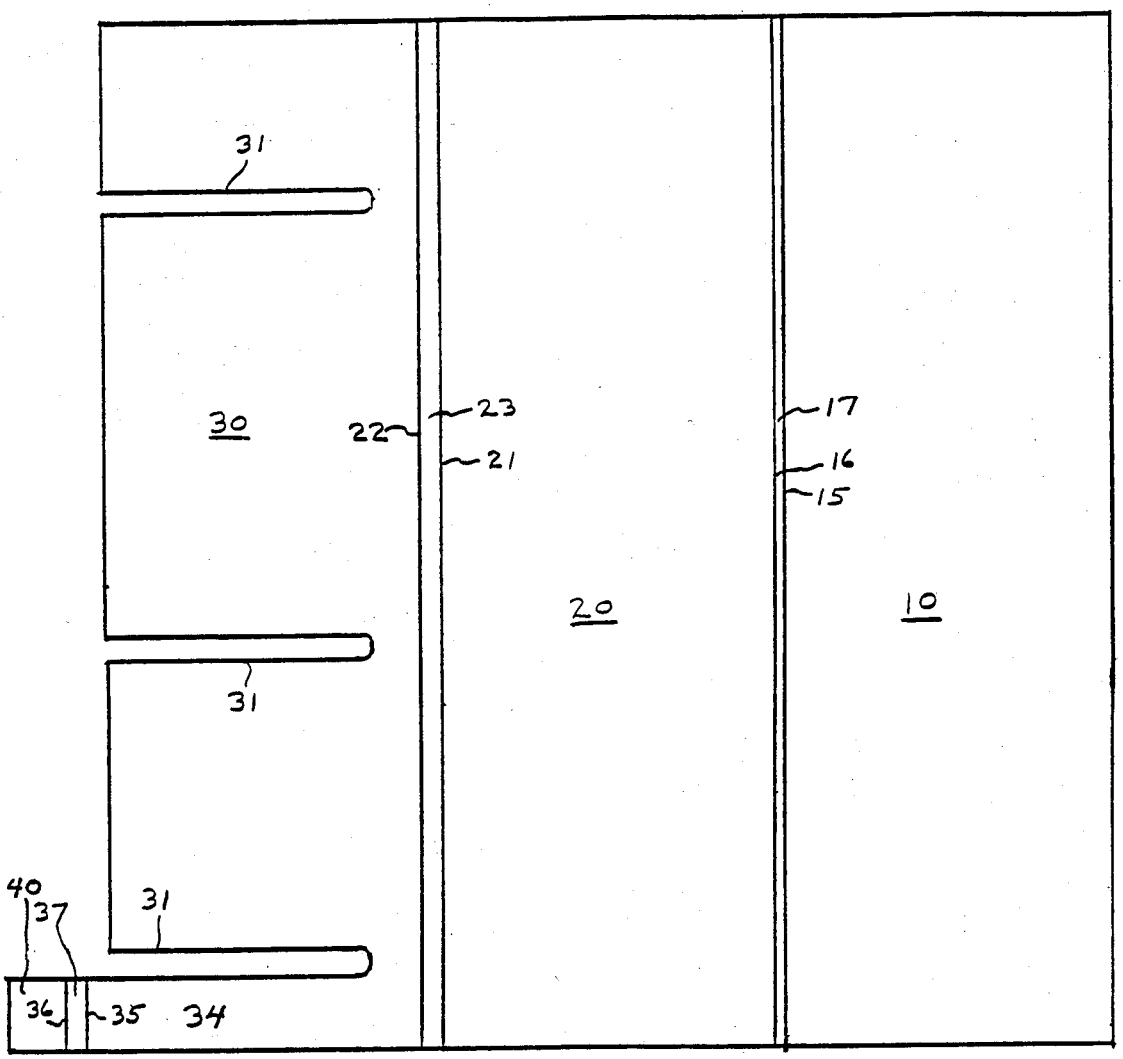
FIG. 1 is a plan view of the outer wrapping layer of the invention subassembly in its flattened position prior to assembly.

Reference is now made to the drawing figures in which like component parts are indicated by like numerals.

FIG. 1 illustrates that the outer wrapping layer is a one-piece element of corrugated fiberboard having three main sections 10, 20 and 30 formed thereon. Sections 10 and 20 are defined by score lines 15 and 16 which are factory produced utilizing known steel rule die technology. Sections 20 and 30 are defined by score lines 21 and 22 in similar fashion.

The third section 30 of the outer wrapping layer of FIG. 1 has plural slots 31 factory formed therein for the receipt of shelving units to be further described.

The third section 30 also has a lower extended portion 34 on which is formed a folding flap 40 via score lines 35 and 36.

From the foregoing description of the score line formation, it will be appreciated that three folding zones are formed on the outer wrapping layer of FIG. 1, i.e. a smaller folding zone 17 and two larger folding zones 23 and 37 respectively.

In assembly of the invention device, section 10 is folded over onto section 20 and appropriately factory glued into position. Next, several corrugated layers are stacked onto the unit and glued into position. Subsequently, section 30 of the outer wrap is folded over such that flap 40 can be tucked into a desired position and the components glued into the required fixed position. Finally, a plastic track element is applied by an adhesive tape to the upright as will be further described.

Figure 2:
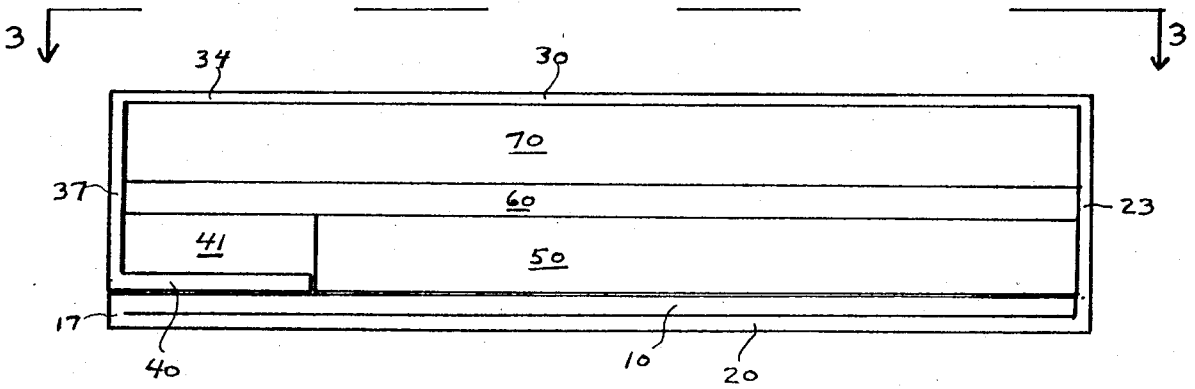
FIG. 2 is a bottom end view of the bar-bookshelf vertical upright in its factory assembled condition.

Referring now to FIG. 2, showing a bottom end view of the vertical upright in its assembled condition, sections 10 and 20 are shown in the position folded onto each other along the smaller folding zone 17. The third main section 30 is also shown in its folded position via folding zone 23 with flap 40 being in its desired tucked in position of assembly.

From FIG. 2, it can be appreciated that the folding zone 23 is of sufficient height to accommodate several layers of corrugated fiberboard, namely layers 50, 60 and 70. In the preferred embodiment of the invention, layers 50 and 70 are formed of double wall corrugated fiberboard material while layer 60 is fabricated of single wall corrugated fiberboard material. The three intermediate layers 50, 60 and 70 serve to build up the upright into a thick and durable unit for extended use in a bookshelf or bar structure. Thus, while light weight and inexpensive materials are utilized throughout the assembly, the stacked and uniquely engineered design results in a highly stable end product.

Two of the intermediate layers 60 and 70 further serve as shelf retaining and receiving means as will be further described.

As further shown in FIG. 2, a pad element 41 is glued to the inside portion of flap 40 to serve as a spacer for said flap element.

Figure 3:
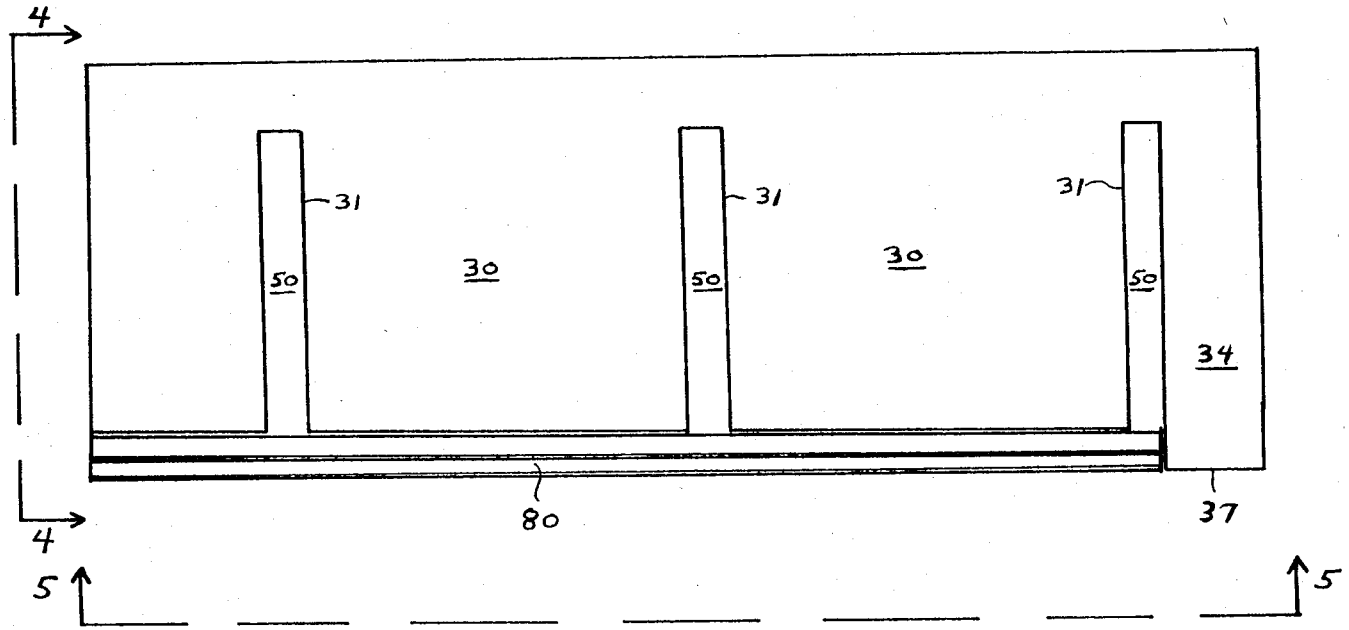
FIG. 3 is a plan view of the vertical upright along lines 3—3 of FIG. 2 in its assembled condition.

As shown in the assembled view of FIG. 3, plural slots 31 are formed in third section 30. Slots are also formed in the intermediate corrugated layers 60 and 70 so that the lower intermediate layer 50 is visible in FIG. 3.

As further shown in FIG. 3, an extended portion 34 serves to allign a plastic double track element 80 in its desired position.

Figure 4:
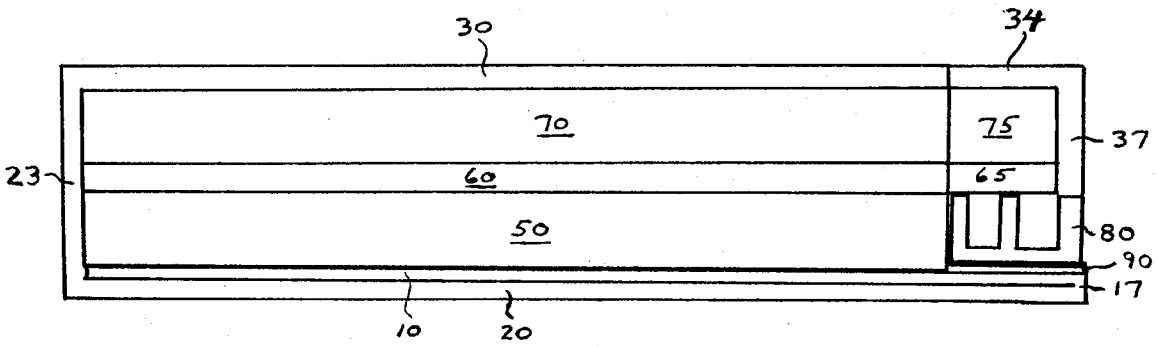
FIG. 4 is a top end view of the vertical upright along lines 4—4 of FIG. 3 in its assembled condition.

As shown in FIG. 4, the plastic track means 80 is mounted permanently to an edge portion of section 10 via a suitable adhesive tape 90. FIG. 4 also illustrates that extended portions 75 and 65 of layers 70 and 60, respectively, are formed so as to underlie the extended portion 34 of the outer wrapping layer 30.

In practice of the invention, it is contemplated that the height of the track element 80 would be equal to the thickness of the lower intermediate corrugated layer 50.

Figure 5:
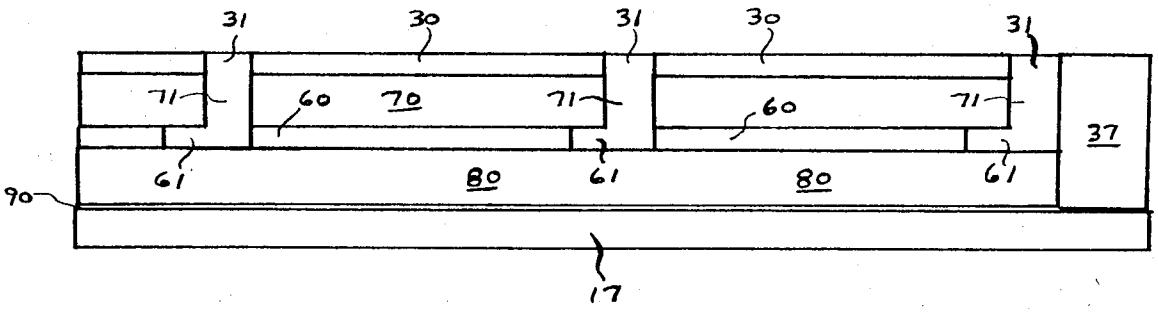
FIG. 5 is a side elevational view of the vertical upright along lines 5—5 of FIG. 3 in its assembled condition.

FIG. 5 illustrates the shelf-receiving slotted construction of the invention. As shown, the outer wrapping layer 30 has slots 31 formed therein. Plural slots 71 are formed in the intermediate double wall corrugated layer 70 so as to form extensions of the upper slots 31. In addition, widened slots 61 are formed in the intermediate single wall corrugated layer 60 to form a further extension of the upper slots 31 and 71.

Thus, the cooperation of the two narrower slots 31 and 71 and the widened slot 61 allows shelves having a single flap formed thereon to be easily slid into the unit and be retained in position without the need for screws or other separate fastener means. The widened slot means 61 is therefore of critical importance to the stable construction of an overall bar or bookshelf unit.

It should be further noted that, in the view of FIG. 5, the intermediate corrugated layer 50 is located behind the plastic track means 80. FIG. 5 also further illustrates that the folding zone 37 is of sufficient width to encompass the three intermediate layers 50, 60 and 70.

In assembly of the full bar or bookshelf, two vertical assembled uprights are used and flapped shelving units are inserted in the channel means formed by the slots 31, 71 and 61. Next, a panel is slid into the plastic track means 80. It will be appreciated that, upon insertion of a panel into track means 80, the fluted edges of layers 30, 70 and 60 are covered thus giving the unit an overall finished appearance from all sides.

Further, all visible layer of the completed assembly have a factory applied vinyl decorative layer thereon to greatly enhance product appearance. Note, for example, that the visible portions of the device shown at numerals 20, 23, 30, 34 and 37 would have such a vinly attractive layer factory applied thereto.

The plastic track means 80, in addition to permitting the somewhat unattractive fluted ends of the panels to be covered, also yields a system wherein varied panels can be used in a bar structure. Such panels could be utilized for various promotional, advertising or congratulatory messages. It is contemplated, for example, that various panels would be sold with the bar unit so that the bar appearance could be readily changed depending upon the particular needs of the purchaser.

Thus, a solid yet light weight unit is produced which may be shipped and stored in a knockdown position and which may be readily assembled by unskilled personnel without the need for tools or fasteners.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

I claim:

1. A vertical upright means for use as a bar or bookshelf subassembly comprising:

an outer wrapping layer comprising plural main sections separated by folding zone means, wherein at least one of said plural main sections (30) has slot means (31) formed therein and a lower extended portion (34) on which is formed a folding flap means (40), said vertical upright means further comprising plural intermediate layers (50, 60, 70) fabricated of corrugated fiberboard material, said plural intermediate layers being positioned within said outer wrapping layer, wherein said outer wrapping layer has at least one main section means (20) which extends beneath and beyond said plural intermediate layers (50, 60, 70) such that a track means (80) may be affixed to said at least one main section (20) via attachment means (90), wherein said outer wrapping layer comprises a first main section (10), a second main section (20) and a third meain section (30), wherein said first main section (10) and said second main section (20) are separated by a narrow folding zone means (17), wherein said second main section (20) and said third main section (30) are separated by a relatively wider folding zone means (23), means whereby said first main section (10) is folded over onto said second main section (20) upon assembly of the apparatus to provide a supporting surface for said track means (80), wherein said plural intermediate layers comprise: a first layer (50) being attached to the first main section (10) of the outer wrapping layer, a second layer (60) being placed adjacent to said first layer (50), and a third layer (70) being placed adjacent to said second layer (60), wherein said third intermediate layer means (70) has slot means (71) formed therein and sized so as to directly underlie the slot means (31) formed in said outer wrapping layer third main section (30), wherein said second intermediate layer means (60) has widened slot means (61) formed therein which extend into the slot means (71) formed in said intermediate layer (70), wherein said first intermediate layer means (50) is formed of a layer of double wall corrugated fiberboard material, wherein said second intermediate layer means (60) is formed of a layer of single wall corrugated fiberboard material, wherein said third intermediate layer means (70) is formed of a layer of double wall corrugated fiberboard material, wherein said track means (80) is comprised of plastic material and wherein said track means (80) is attached to said first main section (10) of the outer wrapping layer via tape means (90), wherein said track means (80) has a height substantially equal to the thickness of said first intermediate layer (50) and is positioned adjacent to said first intermediate layer (50).

* * * * *